US008733544B2

(12) United States Patent
Ashley

(10) Patent No.: US 8,733,544 B2
(45) Date of Patent: May 27, 2014

(54) NECKTIE TRAVEL BAG

(76) Inventor: Jason Ashley, Whittier, CA (US)

( * ) Notice: Subject to any disclaimer, the term of this patent is extended or adjusted under 35 U.S.C. 154(b) by 0 days.

(21) Appl. No.: 13/271,228

(22) Filed: Oct. 12, 2011

(65) Prior Publication Data

US 2013/0092568 A1 Apr. 18, 2013

(51) Int. Cl.
*B65D 85/18* (2006.01)

(52) U.S. Cl.
USPC ..... 206/285; 206/278; 2/44

(58) Field of Classification Search
USPC ..... 206/278, 288, 287.1, 287, 292, 283, 206/299; 2/46, 49
See application file for complete search history.

(56) References Cited

U.S. PATENT DOCUMENTS 1,081,848 A * 12/1913 Macdonald ..... 312/4
1,159,743 A * 11/1915 Buxton ..... 206/278
1,163,683 A * 12/1915 Osgood ..... 206/278
2,057,838 A 10/1936 Levy
2,171,077 A 8/1939 Branch
3,737,013 A * 6/1973 Powell ..... 206/287.1
3,809,194 A * 5/1974 Chappelle et al. ..... 206/287
4,390,087 A * 6/1983 Goldfinger ..... 206/287
4,453,273 A * 6/1984 Gerrick ..... 2/46
4,593,812 A 6/1986 Dillingham
4,716,595 A * 1/1988 Camphous ..... 704/216
D299,789 S * 2/1989 Merz ..... D3/293
5,181,670 A 1/1993 Eaton
6,047,402 A * 4/2000 Chester-Salter ..... 2/46
6,050,403 A 4/2000 Draney
6,499,590 B1 * 12/2002 Godshaw et al. ..... 206/278
6,691,319 B1 * 2/2004 Simon ..... 2/144
6,691,320 B2 * 2/2004 Smith ..... 2/145

* cited by examiner

*Primary Examiner* — Sue A Weaver
(74) *Attorney, Agent, or Firm* — Louis F. Teran

(57) ABSTRACT

The necktie travel bag of the present invention is designed and configured to maintain one or more neckties flat and unwrinkled during travel or storage so that it can be ready to be worn by a user and accent the attire instantly upon unpacking. By allowing the neckties to be packed in a perfectly elongated flat configuration without any folding or bending, the necktie travel bag maintains the neckties unwrinkled and flat even if it is shoved inside a suit case or suit bag along with a multitude of other items that shift and move during travel. The rigidly flexible material that is used to make the necktie travel bag of the present invention keeps the neckties unwrinkled while a hook attachment allows the necktie travel bag to be hung inside a suit bag or a closet.

2 Claims, 4 Drawing Sheets

NECKTIE TRAVEL BAG

BACKGROUND OF INVENTION

1. Field of Invention

The present invention is related to an apparatus and method of packing neckties during travel or storage without inadvertent folding or wrinkling. More particularly, the invention relates to a necktie travel bag that allows neckties to be packed or stored in a flat configuration and fully protected from the elements.

2. Description of Prior Art

Neckties mostly worn by men are narrow pieces of fabric worn about the neck and tied in the front. Typically, a necktie has a wide end and a narrow end. When worn around the neck and tied in the front, the wide end lies over or in front of the narrow end. Both ends, typically, are sewn into a truncated symmetrical point at angle of approximately 45 degrees on each side. However, because of the pointed ends, neckties are very easy to rumple or bend at the ends or at other delicate points when stored or placed inside a travel suitcase or package.

Neckties, by their very nature and purpose, are fashion items meant to ascent the attire of the wearer. Furthermore, the cost of neckties continues to escalate due to the quality of fabrics and craftsmanship that goes into making them. As such, it is important for the wearer to protect his neckties while traveling or during storage. Due, particularly, to the pointed wide and narrow ends and to the specialty fabrics used in neckties, neckties are difficult to pack inside a suitcase without wrinkling them during travel or even during storage.

Typical suitcases and suit bags do not have suitable means for storing neckties to prevent them from being crushed or otherwise wrinkled. In most cases the neckties tend to slip to the bottom of the bag and are thereby crushed and disfigured by the weight of the other articles contained in the suitcase or suit bag.

Although certain types of necktie travel cases have been developed, those existing in the prior art are characterized as relatively bulky, costly, and cumbersome cases which take up too much room and are not adapted to form a suitable hanger for the neckties when the wearer or traveler reaches his destination.

U.S. Pat. No. 2,057,838, teaches a simple box into which a necktie is folded and placed. The problem with this box is that the necktie has to be folded carefully inside the box. This allows the user to inadvertently fold the necktie into the box improperly, thus resulting in wrinkles and disfigurements of the necktie. Furthermore, the box folds near the center of the necktie forcing the necktie to fold without any support to prevent it from wrinkling at the fold line.

U.S. Pat. No. 2,171,077, teaches a necktie case having two rigid walls hingedly attached to one another. However, this necktie case includes an intricate rack through which the necktie has to be looped. Looping the necktie through the rack is cumbersome and allows room for human error that may result in wrinkling and disfigurement of the necktie. Furthermore, when the rigid walls are closed together, the middle portion of the necktie that is looped through the rack is outside and exposed to the elements. Similarly, the side edges of the walls are not sealed closed, thus exposing the necktie to the elements and allowing the necktie to slide out through the sides during travel. Finally, the rack and other clips protrude out and increase the possibility of being caught or trapped within other garments or items inside a suitcase or suit bag.

U.S. Pat. No. 4,593,812, teaches a case where the rigid walls have been replaced by a flexible cover. However, this case also contains an intricate rack that requires the necktie to be looped through or folded about in a particular and cumbersome manner. Furthermore, the sides of the flexible cover are not closed or sealed, thus, allowing the necktie not only to be exposed to the elements but also to swing side to side and out of the case along with the rack. Such motion of the necktie within the case inevitably causes the necktie to deform and wrinkle.

U.S. Pat. No. 5,181,670, teaches a necktie case that completely encapsulates the entire necktie, unlike the last three prior art discussed above. Encapsulating the entire necktie protects it from the outside elements and allows it to be undisturbed by other garments inside the suitcase or suit bag rubbing against said necktie case. However, this necktie case keeps the necktie rolled about some rods rather than in a flat configuration. The problem is that rolling the necktie about a rod makes it prone to fold on itself while it is rolled. Furthermore, when the necktie is unpacked, it tends to maintain a curvature caused by being rolled up for an extended period of time. Often times, the rolling of the necktie ultimately results in wrinkling and disfigurement.

Finally, U.S. Pat. No. 6,050,403, teaches a necktie case that completely encapsulates the necktie and has all sides closed or sealed from the elements. However, inserting the necktie into this case does require it to be folded at least once near the center. If not done carefully, this can result in some inadvertent folding, wrinkling, of disfigurement of the necktie. Finally, this necktie case is an envelope with panels that fold over one another and are fastened together. Folding the necktie into the case without any wrinkling can be tricky and folding and fastening the panels appropriately can be cumbersome.

Accordingly, there is a need for a necktie travel case which provides suitable support and protection for the ties to prevent them from being wrinkled or crushed, to occupy minimum amount of space, be lightweight, economical to manufacture, and to provide a means for hanging. The necktie case must additionally provide a novel structure for loading and unloading neckties, which is operative without the use of elaborate and bulky racks, rods, or fasteners.

SUMMARY OF THE INVENTION

Accordingly, the present invention has been made in view of the above-mentioned disadvantages occurring in the prior art. The present invention is a necktie travel bag that completely encapsulates one or several neckties within a pocket accessible through a large zipper. Encapsulating the neckties prevents them from being exposed to the elements during travel or storage.

Furthermore, it is a primary objective of the present invention to provide a necktie travel bag that maintains the neckties in a flat configuration without any inadvertent folding, bending, or wrinkling. The neckties are placed inside the pocket in a flat configuration without any bending or rolling as in the prior art.

Another object of the present invention is to provide a necktie travel bag that will maintain the neckties in a flat configuration and prevent any inadvertent bending, folding, or wrinkling while it is packed inside a suitcase or suit bag along with other garments or items that can shift or push against the neckties.

Yet another object of the present invention is to reduce the manufacturing cost and complexity so that the necktie travel bags can be produced and sold economically.

Yet another object of the present invention is to substantially simplify the process of packing the neckties inside the necktie travel bag. Unlike the prior art, the present invention does not require any intricate or careful bending, folding, or rolling of the necktie. The neckties are simply placed inside the necktie travel bag of the present invention in an extended and flat configuration.

The above objects and other features of the present invention, as well as the structure and operation of various embodiments of the present invention, are described in detail below and with reference to the accompanying drawings.

DESCRIPTION OF THE DRAWINGS

The accompanying drawings which are incorporated by reference herein and form part of the specification, illustrate various embodiments of the present invention and, together with the description, further serve to explain the principles of the invention and to enable a person skilled in the pertinent art to make and use the invention. In the drawings, like reference numbers indicate identical or functional similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Reference will now be made to the drawings in which various elements of the present invention will be given numerical designations and in which the invention will be discussed so as to enable one skilled in the art and make use the invention.

Figure 1:
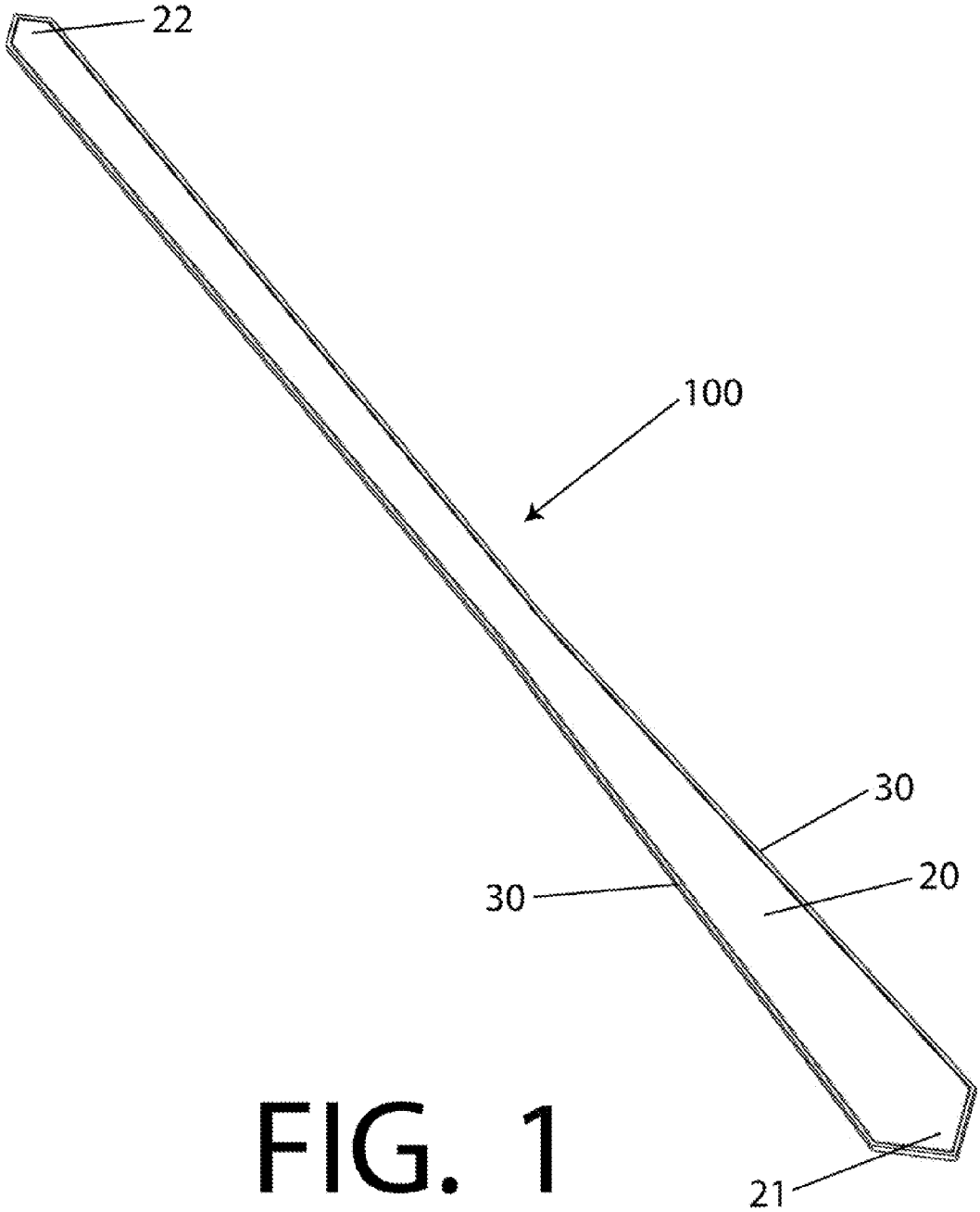
FIG. 1 is a perspective view of the front of the necktie travel bag of the present invention in its unfolded state and ready for use.
Figure 2:
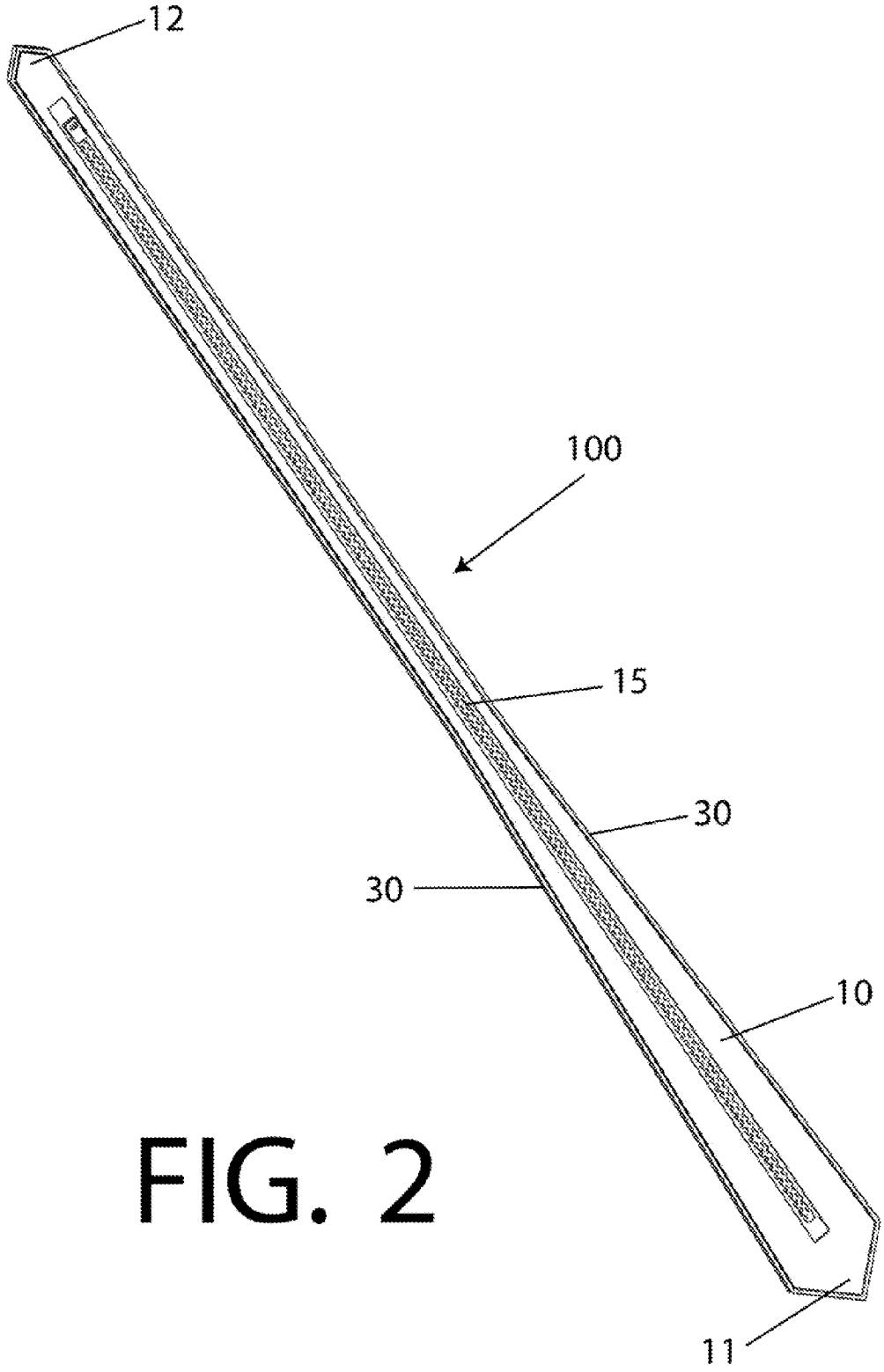
FIG. 2 is a perspective view of the back of the necktie bag of the present invention in its unfolded state and ready for use.

The present invention comprises a necktie travel bag 100 with a top cover 10 and a bottom cover 20 that are placed on top of one another and sewn together all around the perimeter edges 30, as shown on FIG. 1 and FIG. 2. Both the top cover 10 and the bottom cover 20 have the same shape which is that of a necktie with a wide end 11 and 21 and a narrow end 12 and 22. Both ends have a truncated symmetrical point at an angle of approximately 45 degrees on each side. Although the top cover 10 and the bottom cover 20 are both shaped like a necktie, they are both larger than a necktie but equal in size to one another. The larger size allows the top cover 10 and the bottom cover 20 to be sewn along the perimeter edges 30 and create a pocket 40 within the sewn edges 30 and between the top cover 10 and bottom cover 20 that is of sufficient size to accommodate actual neckties to be packed flat therewithin without any folding or rolling, as shown on FIG. 3.

The top cover 10 has a long zipper 15 extending almost the entire length thereof along the center. The long zipper 15 starts a few inches from the narrow end 12 and terminates a few inches from the wide end 11. The long zipper 15 can be opened to allow the user access to the pocket 40 into which neckties 200 are packed in a flat configuration without any folding to rolling. The long zipper 15 is then closed after the neckties 200 are properly packed within the pocket 40.

The material used for the top cover 10 and bottom cover 20 are flexible enough for the user of the present invention to be able to fold the necktie travel bag 100 along the center but rigid enough that the present invention will not inadvertently fold on itself or wrinkle after it has been placed inside a regular suitcase to suit bag. Such rigidity is attained by making the top cover 10 and/or bottom cover 20 out of materials such as leather, thin plastic, nylon, canvas, and the like. Such materials facilitate the necktie travel bag 100 of the present invention to maintain its flat and unwrinkled shape after it is tightly packed inside a suitcase or suit bag full of other garments and other items.

Figure 4:
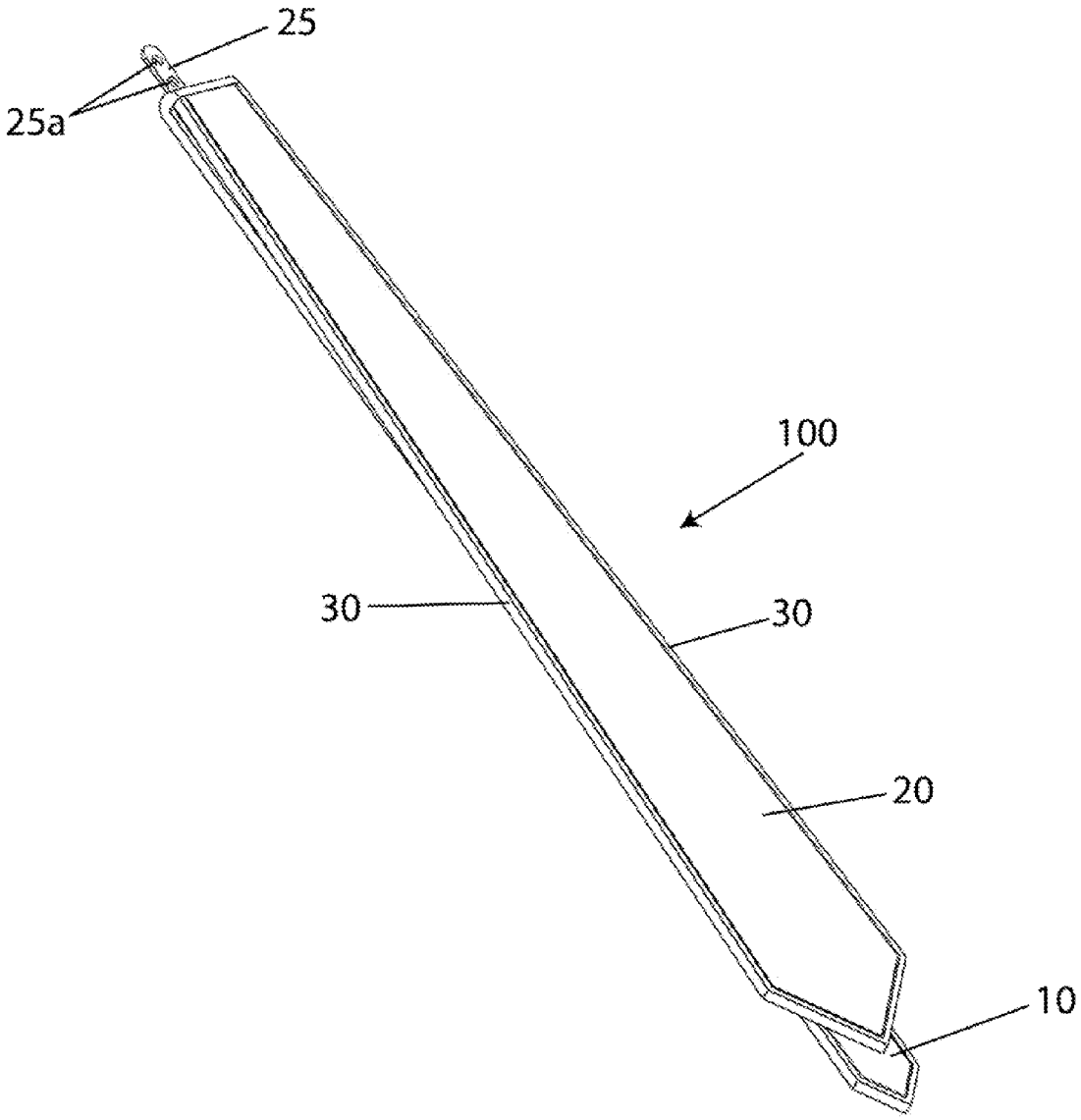
FIG. 4 is a perspective view of the necktie travel bag of the present invention in its folded state with the hook attachment extending upward and ready to be packed in a suitcase or stored in a closet.

As shown on FIG. 4, the bottom cover 20 has a hook attachment 25 attached on the center so that when the necktie travel bag 100 of the present invention is folded at the center, the hook attachment 25 extends upward to expose hooks 25*a* that can be used to hang the necktie travel bag 100 of the present invention in a closet or inside a suitcase or suit bag for storage or travel. The hook attachment 25 is preferably made out of a rigid material such as a thick leather or plastic to maintain a rigid structure that does not deform easily by the weight of the necktie travel bag 100 and the neckties 200 packed therewithin. The preferred embodiment of the present invention has the hook attachment 25 sewn on to the center of the bottom cover 20. Other alternatives of attaching said hook attachment 25 on to the bottom cover 20 can be gluing, sonic welding, heat staking, and the like.

Hereinafter, the method of using the necktie travel bag 100 of the present invention will be given in detail.

Figure 3:
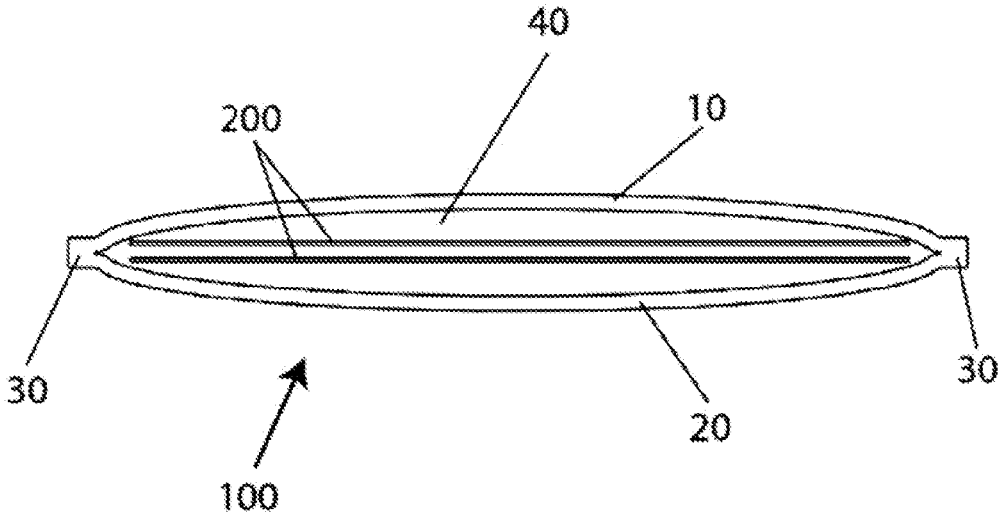
FIG. 3 is a sectional view of the necktie travel bag of the present invention and shows multiple neckties packed inside the pocket.

The top cover 10 of the necktie travel bag 100 of the present invention has a long zipper 15 that is opened to gain access to the pocket 40 into which the neckties 200 are packed. The neckties 200 are packed inside the pocket 40 in a flat configuration. Packing the neckties 200 does not require any bending or rolling as is required by the prior art. The neckties 200 are simply extended out flat without any folds or bends and placed inside the pocket 40. The shape and size of the pocket 40 is made to accommodate one or multiple neckties 200 stacked on top of the other, as shown in FIG. 3. Once the neckties 200 are packed inside the pocket 40, the long zipper 15 is closed so as to completely encapsulate the neckties 200 without allowing any exposure to the elements as done by many of the prior art.

Once the neckties 200 are packed inside the pocket 40 and the long zipper 15 is closed, the necktie travel bag 100 of the present invention is bent or folded along the center so that the narrow ends 12 and 22 is underneath the wide ends 11 and 21. The rigidity of the top cover 10 or the bottom cover 20 ensures that the neckties 200 inside the pocket 40 are also bent or folded along the center an nowhere else. Thereafter, the necktie travel bag 100 of the present invention can be packed inside a suitcase or a suit bag. The rigidity of the top cover 10 or the bottom cover 20 ensures that the neckties 200 inside the pocket 40 are only bent along the center in a flat configuration without any wrinkling, folding, or bending anywhere else, even as the necktie travel bag 100 is pushed or squeezed by other garments or items inside the suitcase or suit bag. Thus, it is the rigidity of the top cover 10 or the bottom cover 20 and the full encapsulation of the neckties 200 within the pocket 40 that protects the neckties 200 from the elements and maintains them unwrinkled during travel or storage so that they can be ready to wear by the user to accent the attire of the wearer instantly upon unpacking them from the pocket 40 without any ironing or straightening.

When the necktie travel bag 100 is bent or folded along the center 30, the hook attachment 25 extends upward, as shown in FIG. 4, to expose hooks 25*a* that can be used to hang the necktie travel bag 100 in a closet or inside a suitcase or suit bag for storage or travel. In addition to the hook attachment 25, the bottom cover 20 may have a small zipper that opens into a small pouch that can be used to store some small items or accessories, such as tie clips, shirt cufflinks, and the like.

Furthermore, the preferred embodiment of the present invention has an wide end section that is made out of a clear material, such as a clear fabric or a clear plastic. This wide end section is located at the wide end 11 and serves as a window for the user to be able to see a portion of the neckties 200 packed inside the pocket 40. Allowing the user to see a portion of the neckties 200 allows the user to identify the neckties 200 packed inside without having to open the long zipper 15.

Finally, unlike much of the prior art that requires multiple components made out of various materials followed by some assembly to put them all together, the necktie travel bag 100 of the present invention only requires a top cover 10 and a bottom cover 20 that can be made out of the same material and a long zipper 15 all assembled together with some sewing. Thus, the cost of the present invention is driven mostly by the cost of the materials rather than the labor costs. Accordingly, the cost of the necktie travel bag 100 of the present invention is lower than the cost of most of the prior art.

It is understood that the described embodiment of the present invention is illustrative only, and that modifications thereof may occur to those skilled in the art. Accordingly, this invention is not to be regarded as limited to the embodiments disclosed, but to be limited only as defined by the appended claims therein.

What is claimed is:

1. A necktie travel bag comprising:

a top cover and a bottom cover each of which are elongated substantially identical and flat;

said top cover and said bottom cover both comprising a wide end, a narrow end, and a shape substantially corresponding to a necktie that is unfolded and elongated in a flat configuration;

said top cover and said bottom cover being oriented with respect to one another such that said top cover is imposed on said bottom cover;

said to cover and said bottom cover being bonded together along all of their sides; and a zipper that extends along the length of said top cover so that at least one necktie that is unfolded and elongated in a flat configuration can be inserted in between said top cover and said bottom cover such that said necktie does not inadvertently fold or wrinkle during travel or storage.

2. The necktie travel bag according to claim 1 further comprising:

a. hook attached to said bottom cover to facilitate the hanging of said necktie travel bag.

* * * * *